US008932158B2

(12) United States Patent
Caligure

(10) Patent No.: US 8,932,158 B2
(45) Date of Patent: Jan. 13, 2015

(54) GRIP DEVICE

(71) Applicant: Michael J. Caligure, Bend, OR (US)

(72) Inventor: Michael J. Caligure, Bend, OR (US)

( * ) Notice: Subject to any disclaimer, the term of this patent is extended or adjusted under 35 U.S.C. 154(b) by 176 days.

(21) Appl. No.: 13/679,809

(22) Filed: Nov. 16, 2012

(65) Prior Publication Data

US 2014/0141899 A1 May 22, 2014

(51) Int. Cl.

| | |
|---|---|
| ***A63B 59/06*** | (2006.01) |
| ***A63B 53/14*** | (2006.01) |
| ***A63B 59/00*** | (2006.01) |
| *A63B 69/36* | (2006.01) |
| *A63B 53/16* | (2006.01) |
| *A63B 69/00* | (2006.01) |

(52) U.S. Cl.

CPC ..... *A63B 59/0025* (2013.01); *A63B 59/0029* (2013.01); *A63B 59/0074* (2013.01); *A63B 59/06* (2013.01); *A63B 69/3632* (2013.01); *A63B 53/14* (2013.01); *A63B 53/16* (2013.01); *A63B 2069/0008* (2013.01); *A63B 2209/00* (2013.01); *A63B 2225/64* (2013.01)

USPC ..... 473/568; 473/302; 473/303

(58) Field of Classification Search

USPC ..... 473/564–568, 457, 519, 520, 300–303

See application file for complete search history.

(56) References Cited

U.S. PATENT DOCUMENTS

| | | | | |
|---|---|---|---|---|
| 2,171,382 | A * | 8/1939 | Wettlaufer | 473/302 |
| 2,984,486 | A * | 5/1961 | Jones | 473/568 |
| 5,294,117 | A * | 3/1994 | Huang | 473/523 |
| 5,577,722 | A * | 11/1996 | Glassberg | 473/457 |
| 5,839,983 | A * | 11/1998 | Kramer | 473/568 |
| 6,406,387 | B1 | 6/2002 | Ryan | |
| 7,125,353 | B2 | 10/2006 | Blount | |
| 7,572,198 | B2 * | 8/2009 | Bleecker | 473/568 |
| 7,744,497 | B2 | 6/2010 | Phelan, Jr. | |
| 8,708,846 | B2 * | 4/2014 | Hisle et al. | 473/568 |
| 2003/0045370 | A1 * | 3/2003 | Jaw | 473/302 |
| 2005/0202910 | A1 * | 9/2005 | Blount | 473/568 |
| 2005/0272537 | A1 * | 12/2005 | Kramer | 473/568 |
| 2009/0312125 | A1 * | 12/2009 | Kearns | 473/451 |
| 2010/0009787 | A1 * | 1/2010 | Vacek et al. | 473/568 |
| 2010/0151975 | A1 | 6/2010 | Hisle et al. | |
| 2011/0039642 | A1 * | 2/2011 | Phelan, Jr. | 473/568 |

OTHER PUBLICATIONS

International Search Report and Written Opinion from corresponding application PCT/US2013/070134 mailed Feb. 11, 2014. 11 pages.

Jameson Innovations LLC, The Bat Jack™ Grip Trainer, www.thebatjack.com, referenced on Nov. 21, 2012. A baseball and softball training aid.

* cited by examiner

*Primary Examiner* — Mark Graham

(74) *Attorney, Agent, or Firm* — Lebert Patent Law P.C.

(57) ABSTRACT

The devices described herein assist the player of a sport involving a bat (e.g., baseball or softball) or club (e.g., golf) to correctly position his or her hands on the bat or club to enhance the power and accuracy of the player's swing.

14 Claims, 6 Drawing Sheets

GRIP DEVICE

BACKGROUND

Sports utilizing clubs or bats, like baseball and golf, have been played for centuries. Proper technique for gripping the shaft of a club/bat is an important aspect in being successful, but learning and mastering this technique is very difficult. Proper gripping technique fosters better swing mechanics, which improves power, distance and control.

SUMMARY

In general, devices are disclosed herein which assist the player of a sport involving a bat e.g., baseball or softball) or club e.g., golf) to correctly position his or her hands on the bat or club to enhance the power and accuracy of the player's swing. The device clips easily and securely onto the shaft of the bat or club, and allows the user to easily grasp the device and then quickly let go of the device after hitting the ball.

In one aspect, the invention features a device comprising a body having a semi-cylindrical portion that defines an open area and that is configured to be snapped onto the shaft of a bat or golf club; and a helical rib extending radially from an outer surface of the body.

Some implementations may include one or more of the following features. The rib and body of the device may together define channels on either side of the rib that are configured to receive the first digit of one of a user's hands and the fifth digit of the other. The rib may be configured to cause the user to hold the bat so that the knuckles of both hands form a straight line that is parallel to the long axis of the bat. In some cases, a portion of a long axis of the rib extends at an angle of 9°-16° with respect to the transverse axis of the device.

In some implementations, the rib has a thickness of less than about 6 mm, e.g., from about 3 to 4 mm. The rib may, in some implementations, protrude from the outer surface of the body a distance of from about 7 to 20 mm.

In some implementations, the body is configured to be used on a baseball bat, and the body has an inner diameter of from about 20 to 32 mm. Some implementations are configured to be used on a softball bat, in which case the body may have an inner diameter of from about 15 to 22 mm. In another implementation, the body is configured to be used on a golf club, and the body has an inner conical diameter of from about 22 to 18 mm.

In another aspect, the invention features methods which comprise a) positioning, on the shaft of a bat or golf club, a device including a body having a semi-cylindrical portion that defines an open area, and a helical rib extending radially from an outer surface of the body; b) utilizing the device to grip the shaft; and c) hitting a ball with the bat or golf club.

The methods may further comprise removing the device from the shaft after use. In some implementations, positioning the device may include clipping the body onto the shaft. The method may also include dropping the bat after hitting the ball by letting go of the device.

DETAILED DESCRIPTION

In preferred embodiments, the devices described herein are configured to be removably attached to the shaft of a baseball bat.

Figure 1:
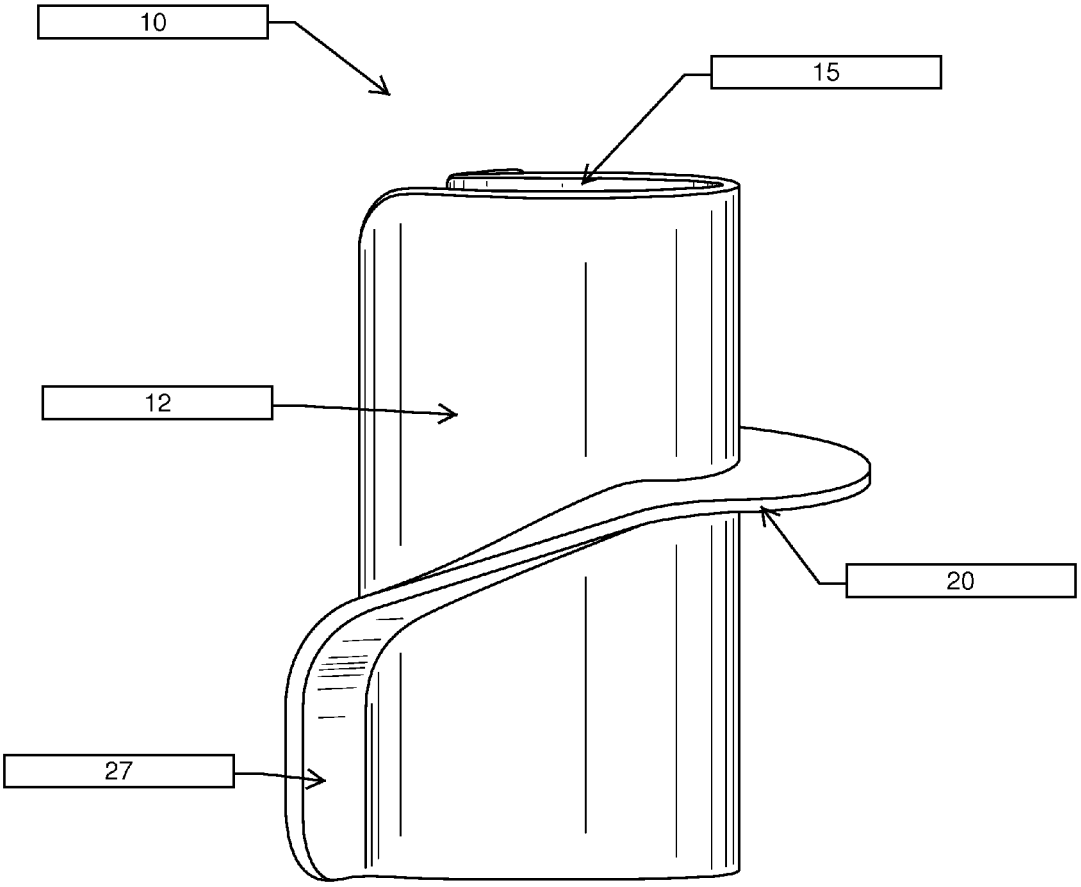
FIG. 1 is a perspective view of a device according to one implementation.

FIG. 1 shows a device 10, which includes a hollow semi-cylindrical body 12 having a central opening 15 that is configured to receive the shaft of a baseball bat, and a rib 20 which extends outward from the body 12 in a radial direction. The device 10, when attached to the shaft of a baseball bat FIG. 5), requires the user to grip the shaft in a manner so that the palmar digital creases of the fingers of both of the user's hands are aligned with the shaft of the bat. This grip increases power and fosters proper swing technique. Alignment occurs because rib 20 causes the user to hold the bat so that the knuckles proximal interphalangeal joints) of both hands form a straight line that is parallel to the long axis of the bat, shown in FIG. 6. Together, the rib 20 and body 12 define channels on either side of the rib. These channels are configured so that the little finger of the user's hand that is closest to the distal end of the bat rests on one side of the rib, and the index finger of the user's other hand contacts the other side of the rib. In the implementation shown, the channels are open at the top rather than being tubes that would receive the fingers), allowing the player to easily grasp the bat, and then easily let it go after batting simply by opening the fingers to release the device from his or her hand.

The rib 20 extends along the length of the body 12, while also wrapping around the body. The rib 20 includes an angled center portion and a pair of generally vertical end portions 25 and 27, which are configured to correctly position the little and index fingers relative to the long axis of the bat, causing the rest of the user's fingers to also assume a correct position. The end portions 25, 27, have generally convex curved surfaces, and are designed not only to position the user's fingers correctly, but also to stop finger rotation, with respect to the shaft, during backswing. The angle of the center portion of the rib 20 with respect to the transverse axis of the device may be from about 7° to 18°, for example 10°-15°. The angling of the rib helps properly align the proximal interphalangeal joints of the hands so that the grip is proper, comfortable, and ergonomically correct.

The device is designed to be thin, so that it is unobtrusive in the user's hand and lightweight. For example, in some implementations the rib may have a thickness of less than about 6 mm, e.g., from about 2 to 5 mm, but preferably 3.5 mm. The rib 20 is generally thick enough to be sufficiently rigid so as to resist distortion during application, while being thin enough to minimize the weight of the device. Preferably, the rib 20 protrudes from the body 12 a sufficient distance to securely position the fingers, while being small enough to minimize weight and not be in the player's way. For example, the rib may protrude from about 7 to 20 mm, e.g., from about 10 to 15 mm. Generally, the taller the rib, i.e. the more the rib protrudes from the body, the stiffer the device and therefore the more it resists distortion. In some implementations the body 12 may have a wall thickness of, for example, from about 2 to 5 mm, for example 3 to 4 mm. Preferably, the body 12 is flexible enough to allow sufficient expansion to receive the shaft, while also being rigid enough so that the device will not fly off when the bat is dropped or thrown.

Figure 2:
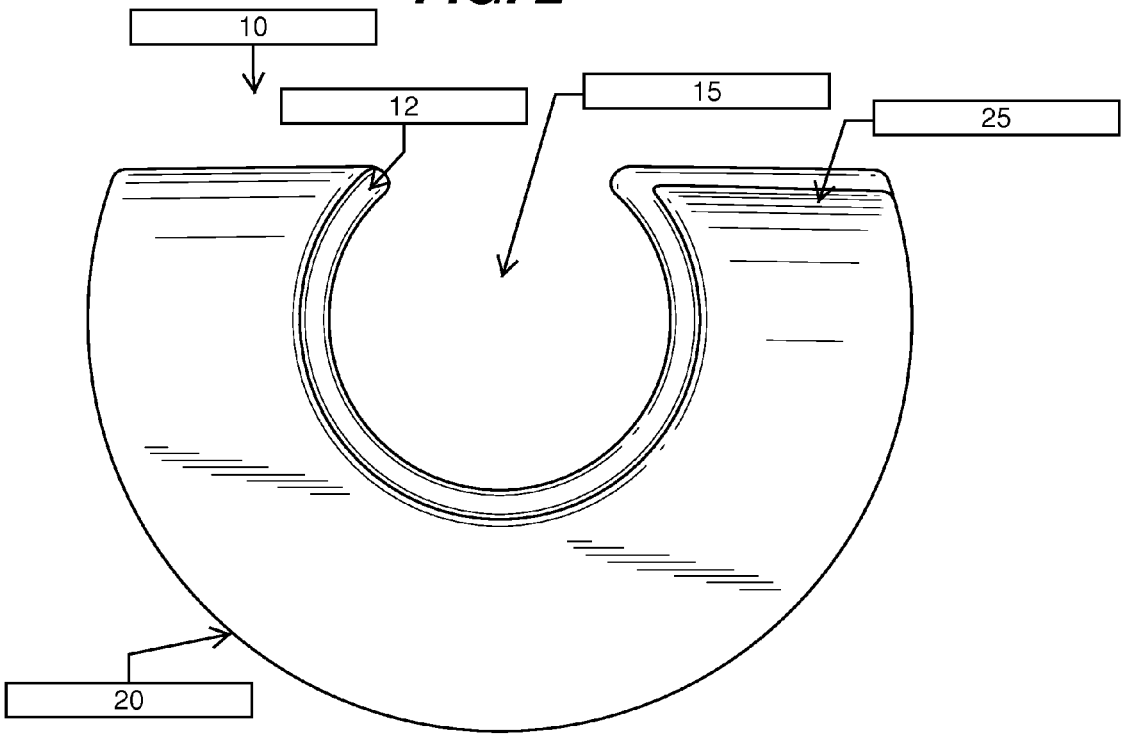
FIG. 2 is a top view of the device.
Figure 3:
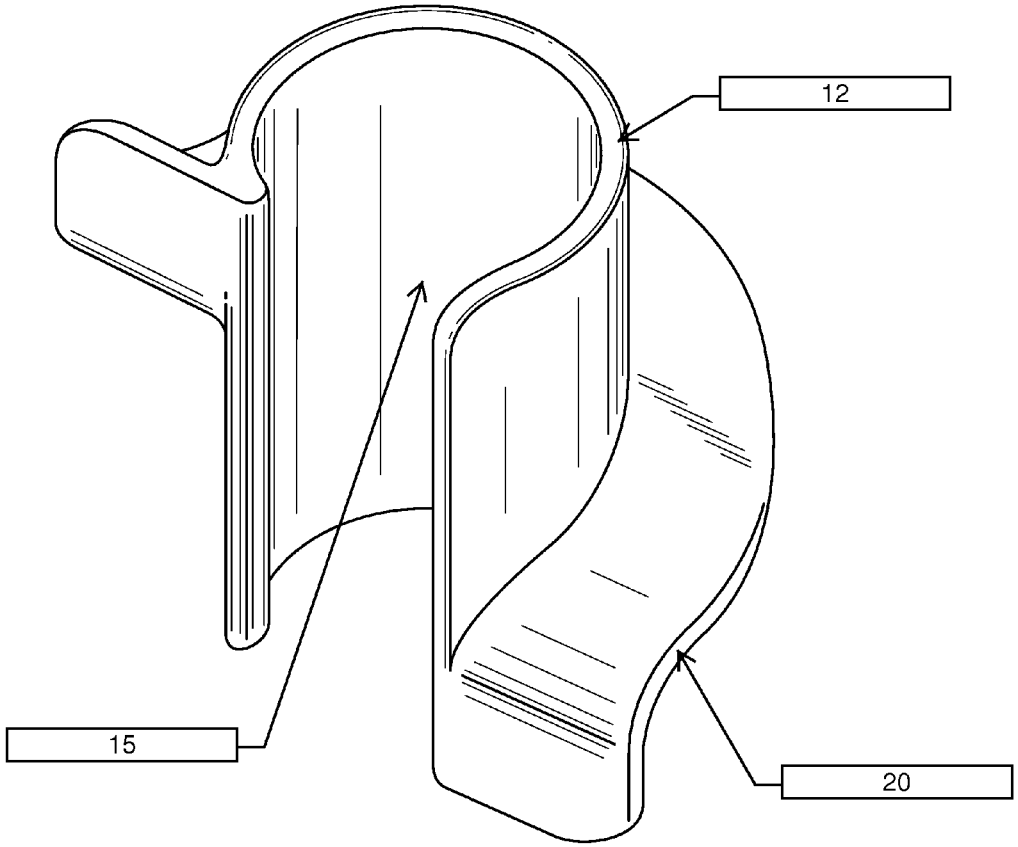
FIG. 3 is an alternate perspective view of the device.
Figure 4:
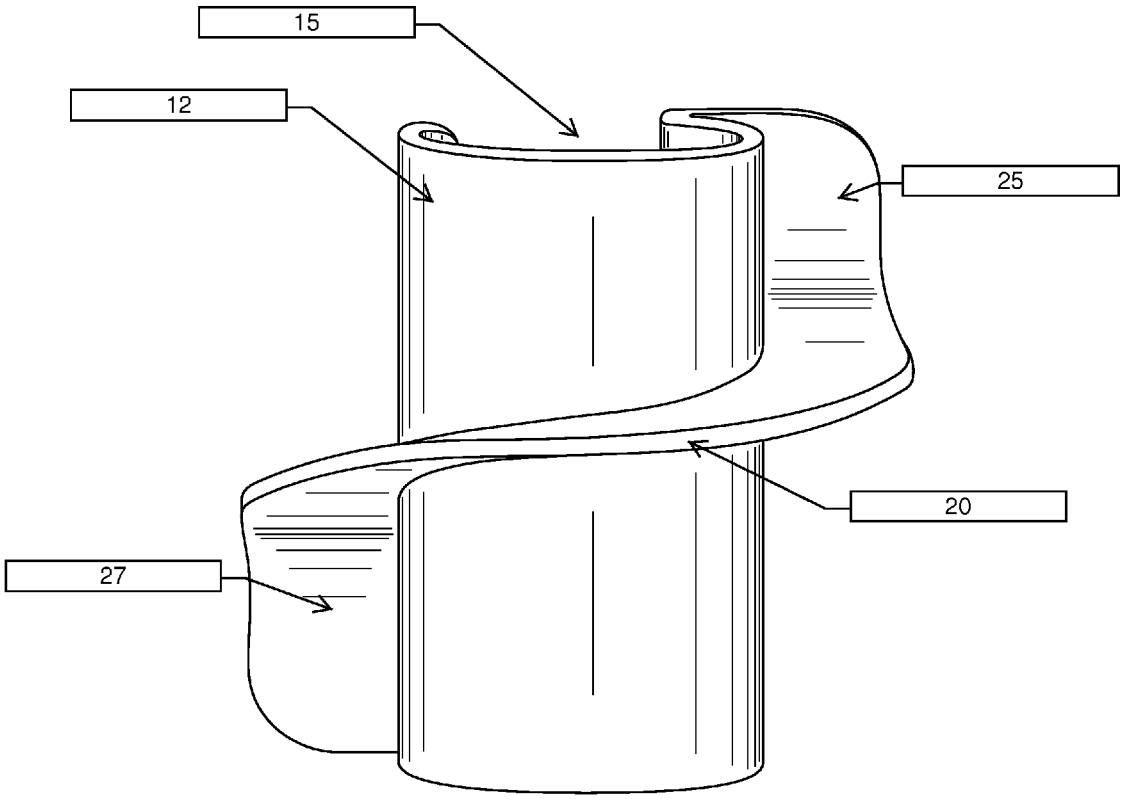
FIG. 4 is another perspective view of the device.
Figure 5:
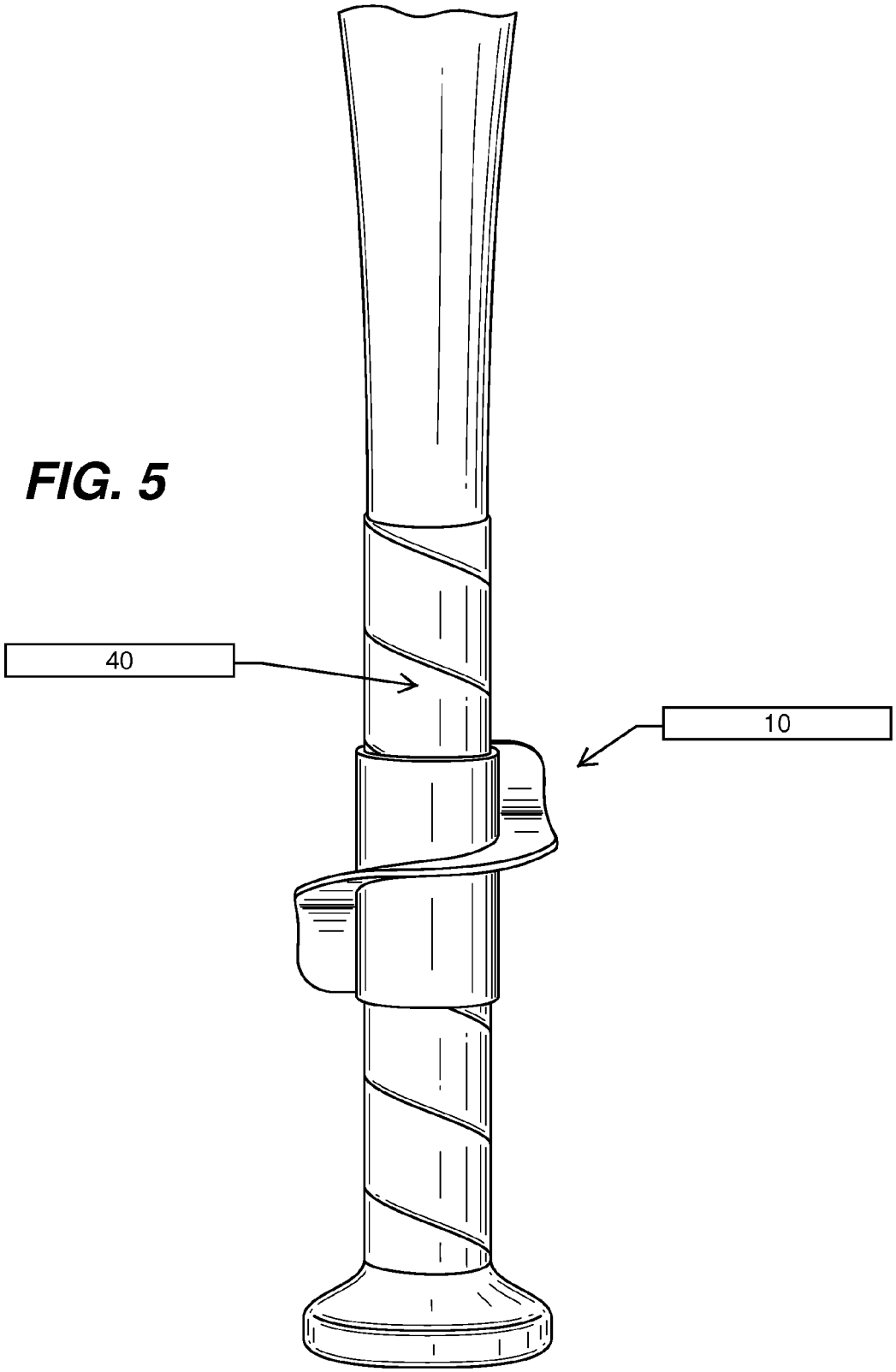
FIG. 5 is a font view of the device attached to the shaft of a bat.
Figure 6:
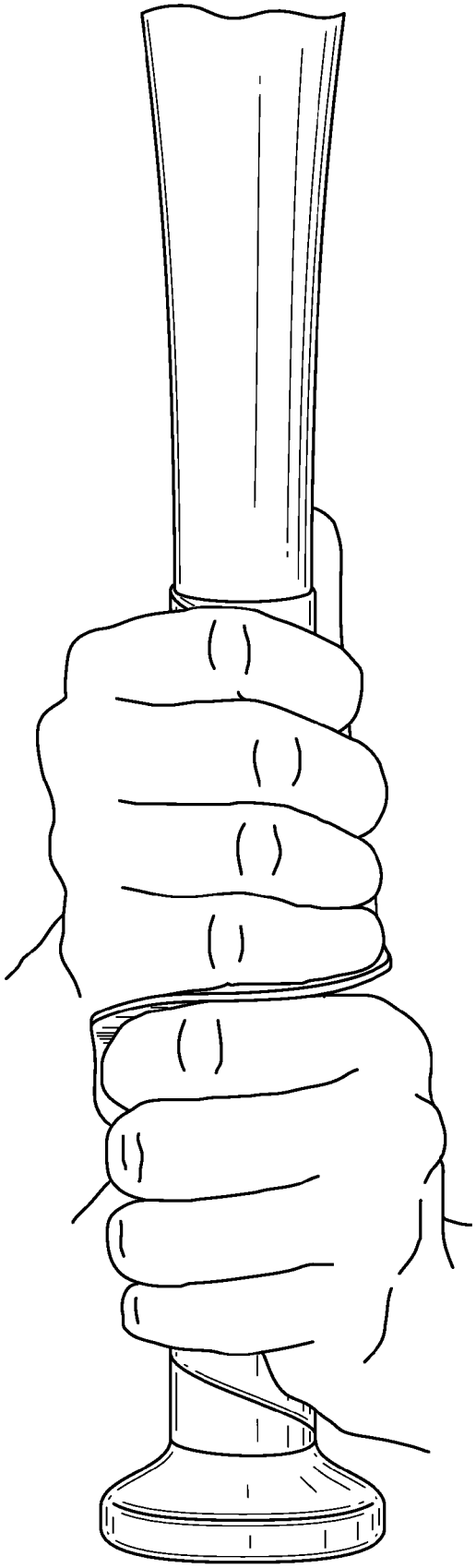
FIG. 6 is a view of the device attached to the shaft of a bat while being properly gripped by two hands.

Referring to FIG. 2, the central opening 15 is cylindrical and is designed to clip onto the shaft of a baseball bat FIG. 5), conforming to the exact shape of the shaft 40. Advantageously, the device clips on easily and stays securely on the shaft without the need for any straps or other securing devices.

When configured for use on the shaft of a baseball bat, the inner diameter of the body 12 may be, for example, 20 to 30 mm, e.g., 22 to 25 mm. When configured for use on the shaft of a softball bat, the inner diameter of the device is preferably 22 mm, but can range from 15 to 24 mm. When configured for use on the shaft of a wooden baseball bat, the inner diameter of the device is preferably 26 mm-31 mm, but can range from 24 nun to 32 mm. The body 12 is sufficiently long so that it will not twist off of the shaft of the bat during use or when the bat is dropped or thrown, without being so long as to add unnecessary weight.

The device 10 may be constructed, for example, of molded plastic. Any desired plastic may be used that provides the desired device characteristics. Most injection moldable thermoplastics are suitable, such as polypropylene, polyurethane, or high density polyethylene. The plastic is generally selected so that the body will have the desired combination of flexibility to clip onto the shaft) with rigidity and structural integrity as discussed above.

Other Embodiments

A number of embodiments have been described. Nevertheless, it will be understood that various modifications may be made without departing from the spirit and scope of the disclosure.

For example, in alternative implementations the device is configured to be applied to the shaft of a golf club. In this case, the inner diameter of the opening 15 is conical in shape such that it is sized to receive the golf club shaft. For example, the inner diameter of the opening may be from about 22 mm at the distal end of the shafts narrowing to about 18 mm at the proximal end in relation to the club head. Generally the other features of the device remain the same.

In some implementations, the device may be made of a thermoplastic that is heat formable to allow the user to custom form the device to the user's hands. Preferably the activation or softening temperature of the material would be higher than the temperatures that would be encountered during use of the device, but relatively low, for example 140-160 degrees Fahrenheit, so that the user could utilize a common heat source, for example, a household oven, to allow customization.

Another embodiment could feature custom coloring of the device.

Accordingly, other embodiments are within the scope of the following claims.

What is claimed is:

1. A device comprising:

a body having a semi-cylindrical portion that defines an open area and that is configured to be snapped onto the shaft of a bat or golf club; and a helical rib extending radially from an outer surface of the body, wherein the rib includes an angled center portion and a pair of generally vertical end portions.

2. The device of claim 1 wherein the rib and body together define channels on either side of the rib that are configured to receive the first digit of one of a user's hands and the fifth digit of the other.

3. The device of claim 1 wherein the rib is configured to cause the user to hold the bat so that the knuckles of both hands form a straight line that is parallel to the long axis of the bat.

4. The device of claim 1 wherein a portion of the rib extends at an angle of 9°-16° with respect to the transverse axis of the bat.

5. The device of claim 1 wherein the rib has a thickness of less than about 6 mm.

6. The device of claim 5 wherein the rib has a thickness of from about 3 to 4 mm.

7. The device of claim 1 wherein the rib protrudes from the outer surface of the body a distance of from about 7 to 20 mm.

8. The device of claim 1 wherein the body is configured to be used on a baseball bat, and the body has an inner diameter of from about 20 to 32 mm.

9. The device of claim 1 wherein the body is configured to be used on a softball bat, and the body has an inner diameter of from about 15 to 22 mm.

10. The device of claim 1 wherein the body is configured to be used on a golf club, and the body has an inner conical diameter of from about 22 to 18 mm.

11. A method comprising:

positioning, on the shaft of a bat or golf club, a device including a body having a semi-cylindrical portion that defines an open area, and a helical rib extending radially from an outer surface of the body wherein the rib includes an angled center portion and a pair of generally vertical end portions;

utilizing the device to grip the shaft; and hitting a ball with the bat or golf club.

12. The method of claim 11 further comprising removing the device from the shaft after use.

13. The method of claim 11 wherein positioning comprises clipping the body onto the shaft.

14. The method of claim 11 wherein a bat is used and the method further comprises dropping the bat after hitting the ball by letting go of the device.

* * * * *